US006305305B1

(12) United States Patent
Johnson

(10) Patent No.: US 6,305,305 B1
(45) Date of Patent: Oct. 23, 2001

(54) KNEEBOARD

(75) Inventor: Chris L. Johnson, Sammamish, WA (US)

(73) Assignee: Earth & Ocean Sports, Inc., Redmond, WA (US)

( * ) Notice: Subject to any disclaimer, the term of this patent is extended or adjusted under 35 U.S.C. 154(b) by 0 days.

(21) Appl. No.: 09/632,904

(22) Filed: Aug. 4, 2000

(51) Int. Cl.[7] ..... B63B 35/79
(52) U.S. Cl. ..... 114/65; 441/74
(58) Field of Search ..... 441/65, 68, 74, 441/75

(56) References Cited

U.S. PATENT DOCUMENTS 4,708,679 * 11/1987 Shoeffler et al. ..... 441/65
4,883,436 * 11/1989 Oakland ..... 441/65
5,700,174 12/1997 Churchill et al. .

* cited by examiner

*Primary Examiner*—Jesus D. Sotelo
(74) *Attorney, Agent, or Firm*—Blodgett & Blodgett, P.C.

(57) ABSTRACT

A kneeboard formed of upper and lower polymeric shells about a core material and having a internal, generally vertical stiffener to impart strength to the kneeboard and to provide a low profile strengthened kneeboard.

9 Claims, 5 Drawing Sheets

KNEEBOARD

BACKGROUND OF THE INVENTION

Towable watersports devices used for recreational and sport purposes include a water sport device known as a kneeboard, which is used by a kneeling user and typically towed by a motor-operated watercraft. Kneeboards are manufactured by a molding process to prepare an upper and lower contoured polymeric rigid shell filled with a core floatation material like a closed cell, e.g., polyethylene or polyurethane, polymeric foam with the shells secured together to form a peripheral sealing lip.

The kneeboard usually has a contoured upper surface, and may include a depressed knee area, to fit the knees or lower legs of the user, with optional cushioning material, like foam pads, for comfort and optional knee straps to restrain a user may also be used.

One prior art kneeboard is described in U.S. Pat. No. 5,700,174, issued Dec. 23, 1997, hereby incorporated by reference. The kneeboard has an upper and lower shell with a lip about a foam core material and has an upper contoured passenger riding area. The kneeboard includes means for strengthening the kneeboard by constructing and arranging the hull and deck with a lip, and wherein the thickness between the dorsal surface of the lip and ventral surface of the lip is less than the average thickness of the shell measured between the dorsal portion of the passenger contact area and the ventral surface of the hull. The kneeboard is also strengthened by combining and integrating a first and second lateral support member, a middle lateral support member and a transverse support member which form contours in the passenger area.

It is desirable to provide an improved kneeboard which avoids the disadvantages of prior art kneeboards and presents a low profile contour, and is internally strengthened without the need for lateral support members, and yet provides good performance, maneuverability and stability properties, and ease and efficiency of manufacture.

SUMMARY OF THE INVENTION

The invention relates to a kneeboard of strengthened construction, and a low profile; such as a kneeboard adapted for use behind a watercraft, which kneeboard comprises: a floatation core material, such as a closed-cell foam material; and a polymeric shell of a moldable hard plastic, like high density, cross-linked polyethylene, which encapsulates the core material to form a kneeboard with a top surface, a bottom surface, opposite sides, a front end and a tail end. The kneeboard includes the top surface defining a passenger area which may be generally planar or depressed, and a first and a second fin cable slot in the top surface of the passenger area, and having a one end and another end, one end extending from the said housing and the other end extending toward the tail end. The cable slots extending downwardly and generally parallel for a selected distance and then each cable slot extending outwardly and toward opposite sides at the other end. The kneeboard includes an internal rib or stiffener means from or about the cable slots, such as a generally vertical stiffener rib extending downwardly from the cable slots, in the core material and toward the bottom surface. The kneeboard includes first and second spaced apart fin slots in the bottom surface toward the tail end and in communication with the first and second fin cable slots, and adapted for the installation of first and second fins.

The kneeboard generally and preferably employs typically two or more spaced apart fins extending fixedly or retractably generally longitudinally from the bottom surface of the kneeboard to impart stability in use and to enhance performance. The fins are secured to or inserted in fin slots in the bottom surface. The fins preferably are retractable by the use of a lever, or other means, on the top surface, and available for passenger use, such as a lever in a fin lever housing. The lever is connected by a pair of fin cables resting in the formed cable slots in the top surface to the fins. The retractable fins are arranged and constructed to move mechanically, usually by separate plastic-covered steel fin cables in the cable slots, on operation of a lever between an extended downward use position (e.g., when the lever is pulled back), and a retracted upward non-use position (e.g., when the lever is pushed forward).

It has been discovered that a low profile, low sectional thickness strengthened kneeboard may be manufactured employing a pair of internal vertical longitudinal stiffeners or ribs from the passenger area to strengthen the kneeboard in use. The internal vertical stiffeners are integrally formed with the upper section of the polymeric shell during the molding process and arranged to extend initially spaced apart and parallel beneath the fin cable slots extending from the lever housing opening, and to extend downwardly as the fin cable slots diverge smoothly and generally arcuately outwardly toward opposite sides, and with the fin cable slots ending by being generally close to and generally parallel to opposite sides for a short distance at the rear of the passenger area.

The fin cable slots are slightly depressed slots molded in the upper shell and arranged to receive and permit the slidable movement of the cables beneath the top surface to control the position of the fins in each fin slot on the bottom surface. The vertical stiffeners or rib preferably extend downwardly from the bottom of the fin cable slots toward or to the upper internal surface of the bottom surface of the lower shell and are surrounded by the foam material. The vertical stiffeners preferably run continuously beneath the fin cable slots and are of the same molded polymeric material as the shell; for example, a molded cross-linked polyolefin.

Further, it has been found that the employment of a pair of slightly raised, e.g. up to ½ to 1½ inches in height, rounded side contour members on each side of the kneeboard extending substantially from the tail end to the front end contributes further to the overall strength of the kneeboard, and that increased sectional thickness and transverse members and a high profile are not required, as in the prior art, where contoured overall sectional thickness of the kneeboard often exceeds 3½ to 4 inches.

The passenger area surface of the kneeboard may be surface contoured (e.g., anti-slip and knurled) to fit a passenger's knees or lower legs, as desired. The kneeboard may employ a generally oval or other design, planar or depressed passenger area with a generally flat bottom passenger surface, and usually with a peripheral passenger pad outer ring about the area. The area is optionally covered in whole or in part with a knee or lower leg cushioning material, such as a flexible, resilient soft foam material, such as a fabric-foam-backing pad material.

The invention will be described for the purposes of illustration only in connection with certain illustrated embodiments wherein the kneeboard includes a cover, cables and fins; however, it is recognized that various changes, modifications, additions, and improvements may be made in the illustrative embodiments without departing from the spirit or scope of the invention. For example, the kneeboard may be used without a lever, fin cables and fins.

DESCRIPTION OF THE EMBODIMENTS

Figure 1:
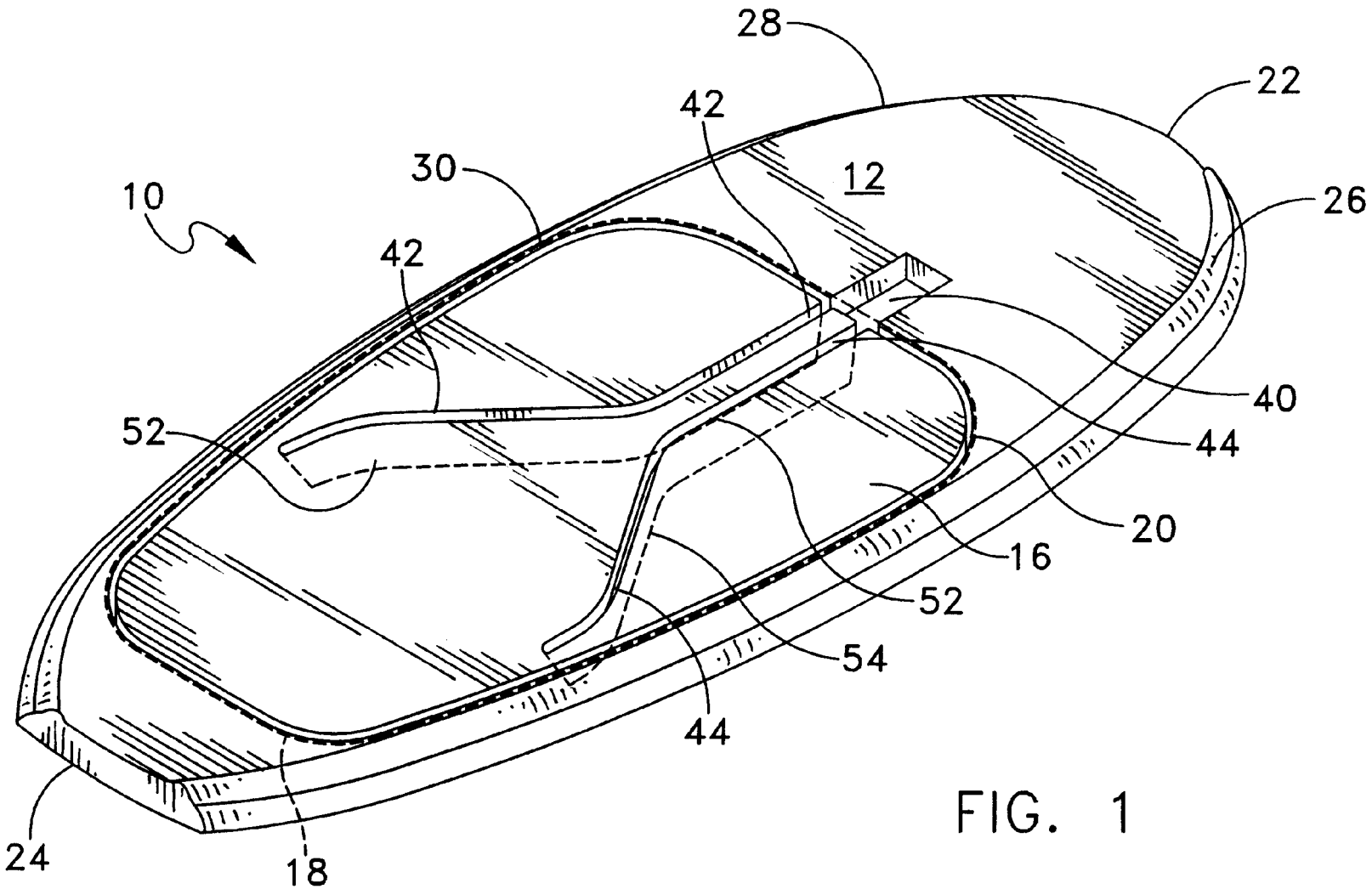
FIG. 1 is a perspective view of the kneeboard of the invention (without a retractable fin mechanism) from the rear top view.

FIG. 1 is a perspective view of a kneeboard 10 formed of one half polymeric rigid molded polyethylene upper shell 12 and a lower shell 14 secured together at the peripheral edges or lips, about a foam core polyurethane floatation material. The upper shell 12 has a top surface characterized by a generally planar passenger contact area 16 which may be covered by a passenger cushion material pad 18 (dotted lines), with a backing sheet, a foam layer and an upper fabric layer (e.g., ½ to 1 inch in thickness). The pad 18 is retained in position and replaceable within a pad ring 20 about the top of the passenger area 16. The kneeboard 10 includes a tapered tail end 24 and rounded front end 22 and has a lateral sectional thickness of less than about 2½ to 3 inches.

FIG. 1 shows the planar top surface of the shell 12, two top rounded side contour members 26 and 28 and a top surface space 30 between the contour members 26 and 28 and the passenger area 16. The upper shell 12 includes a rectangular depressed fin lever housing opening 40 for a vertical lever 48 to raise and lower fins 46 in fin slots 38 by means of connecting cables 50 (see FIG. 5). The top surface includes a pair of surface depressed, open, contoured fin cable slots 42 and 44 on either side. The fin cable slots 42 and 44 extending generally parallel in a close, spaced apart relationship from the housing opening 40 to form a central member 56 with walls between the slots 42 and 44, and then the slots 42 and 44 extend or curve arcuately outwardly toward the tail end 24 of the kneeboard in the passenger area 16. The cables 50 are connected to the lever 48 at one end and run in the fin cable slots 42 and 44 slightly below the top surface 12 and through the shell 14 to the fins 46 positioned in the fin slots 38. The fins 46 are slidable, moveable in the fin slots 38 by passenger movement of the lever 48.

The kneeboard 10 includes vertical stiffeners 52 and 54 of a molded polymer, such as cross linked high density polyethylene polymer. The vertical stiffeners or ribs 52 and 54 extend downwardly from the bottom of the formed fin cable slots 42 and 44 (see FIG. 4) and are integrally molded to the upper shell 12 and extend in the core material toward or to the inner surface of the lower shell 14. The stiffeners 52 and 54 generally follow the design or path of the cable slots 42 and 44 and impart strength to the kneeboard 10 without raising the sectional thickness profile of the kneeboard 10.

Figure 2:
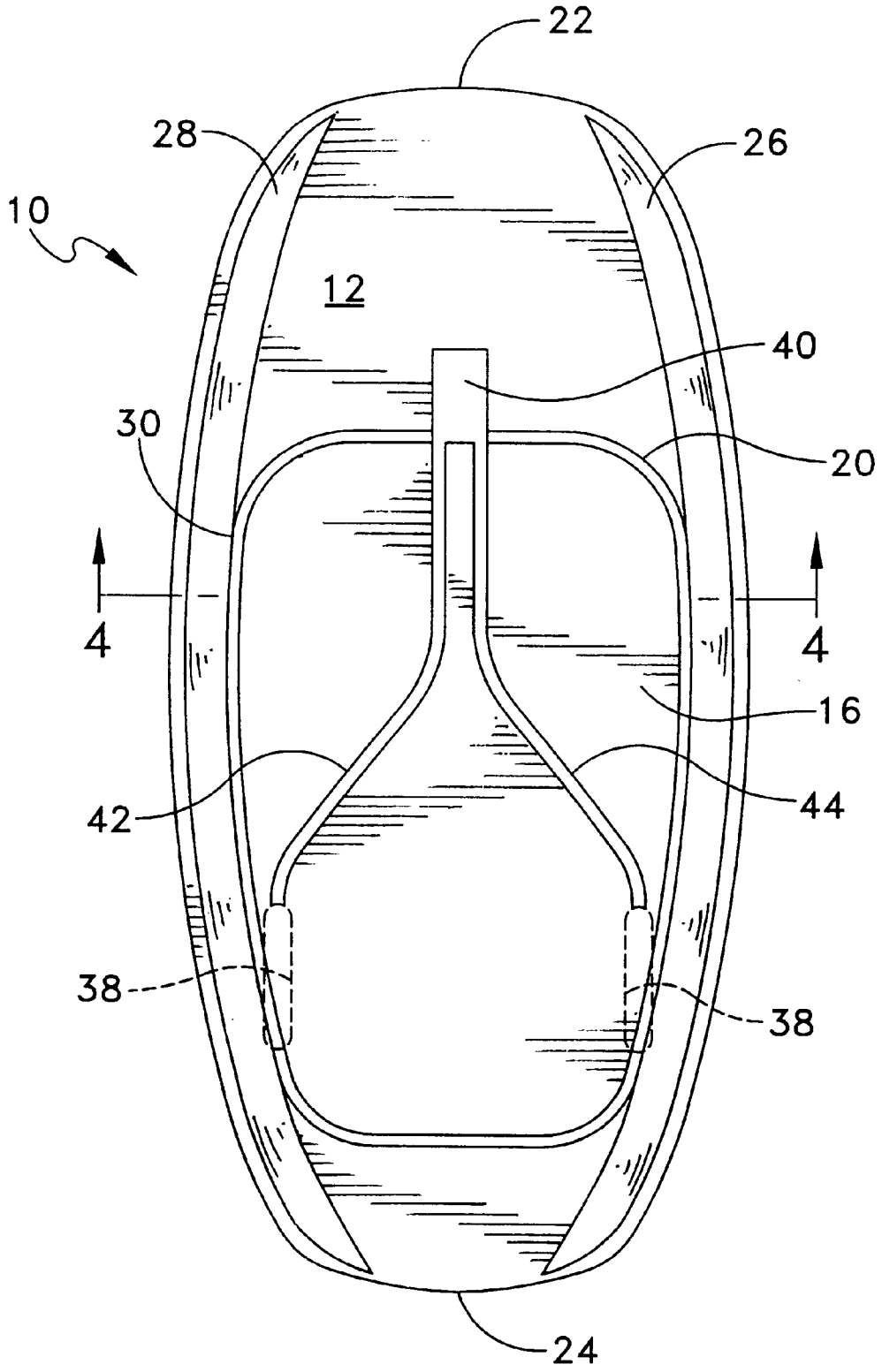
FIG. 2 is a top plan view of the kneeboard of FIG. 1.
Figure 3:
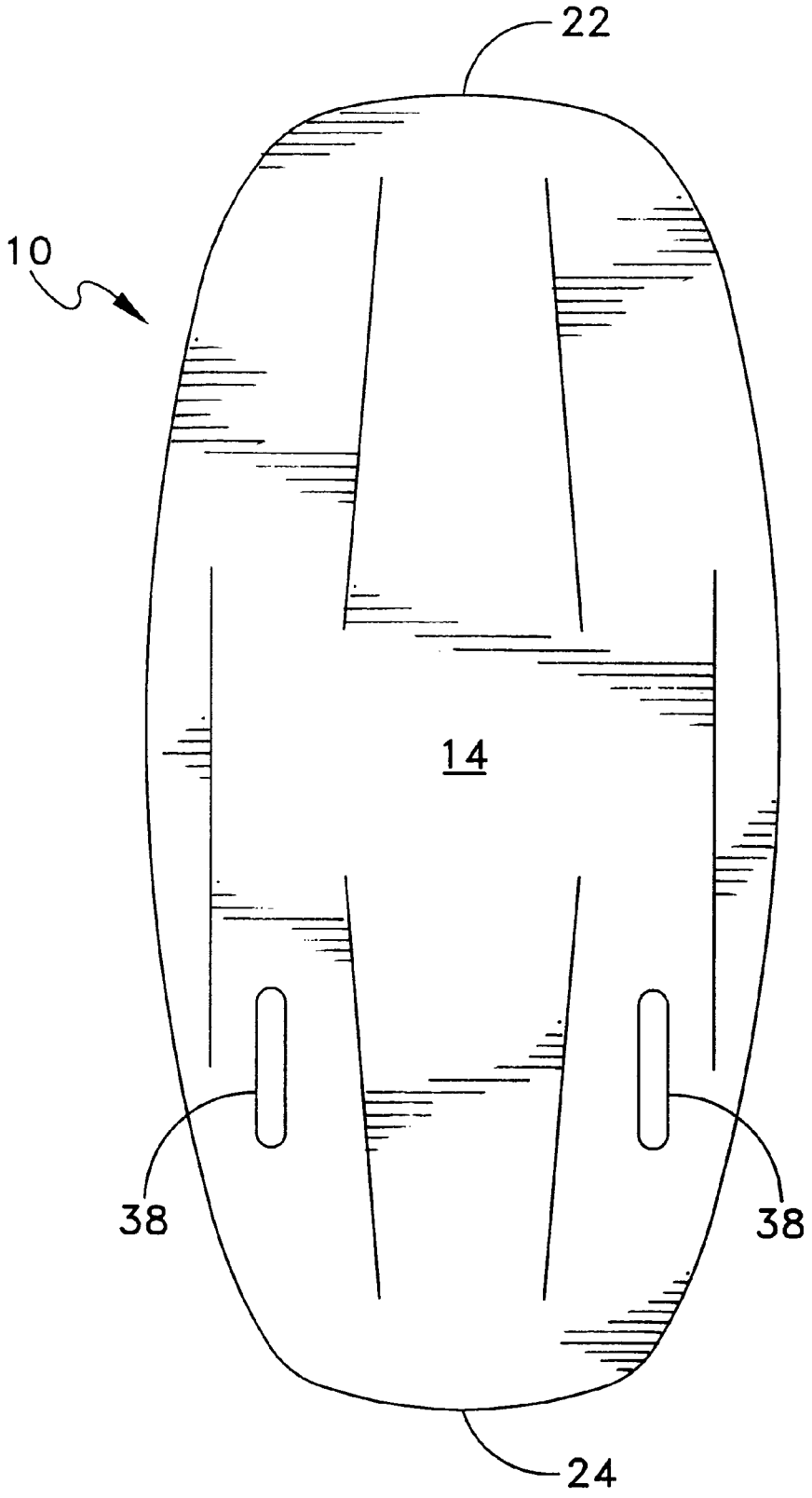
FIG. 3 is a bottom plan view of the kneeboard of FIG. 1.
Figure 5:
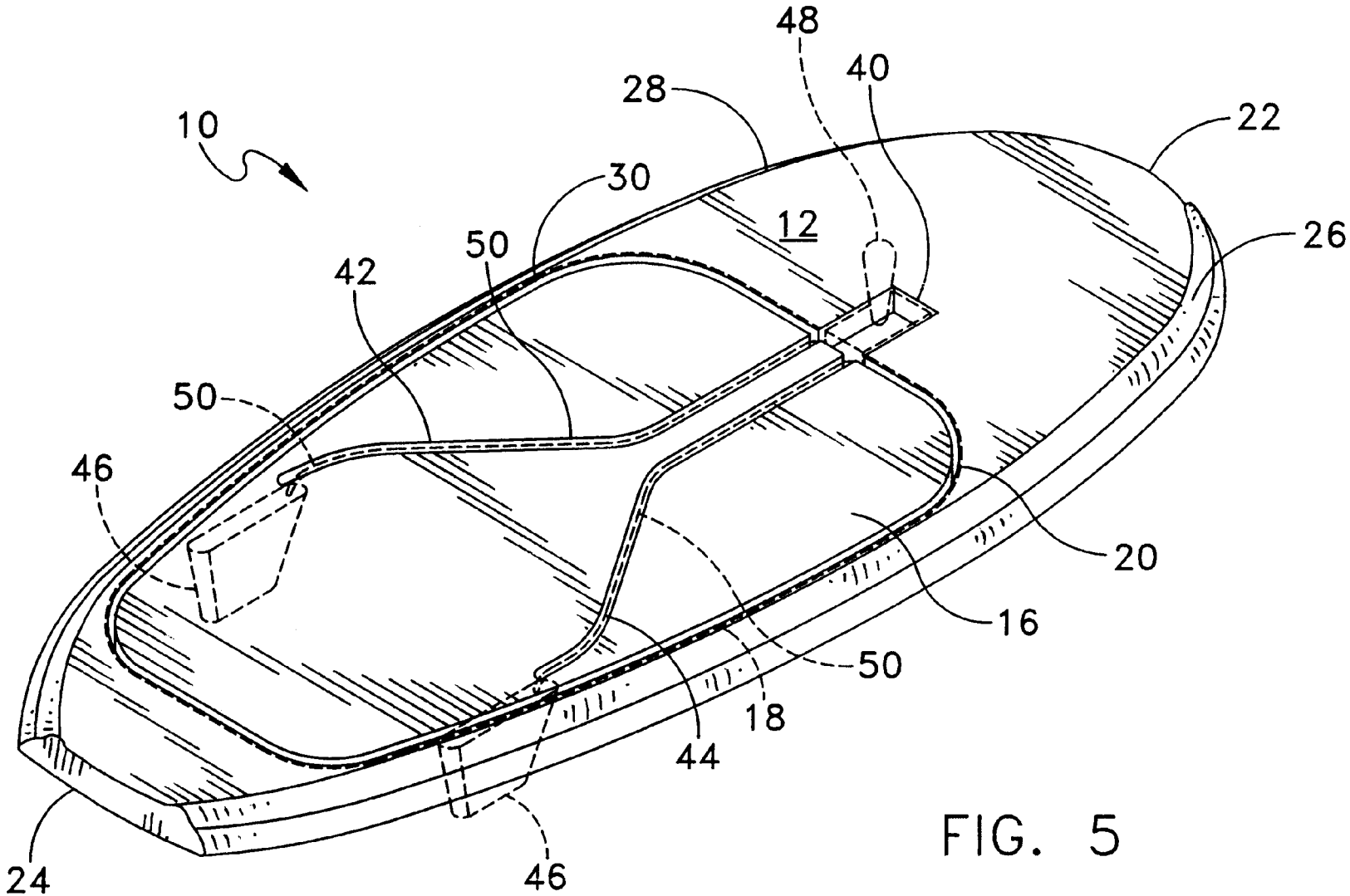
FIG. 5 is a perspective view, from the top rear of the kneeboard of FIG. 1, with fins and a lever added and shown in dotted lines.

FIGS. 2 and 3 are top and bottom plan views of FIG. 1 with fin slots 38 shown in dotted lines in FIG. 2 to receive a pair of fins 46 (see FIG. 5). The longitudinal lines in FIG. 3 represent general contour lines of the bottom surface.

Figure 4:
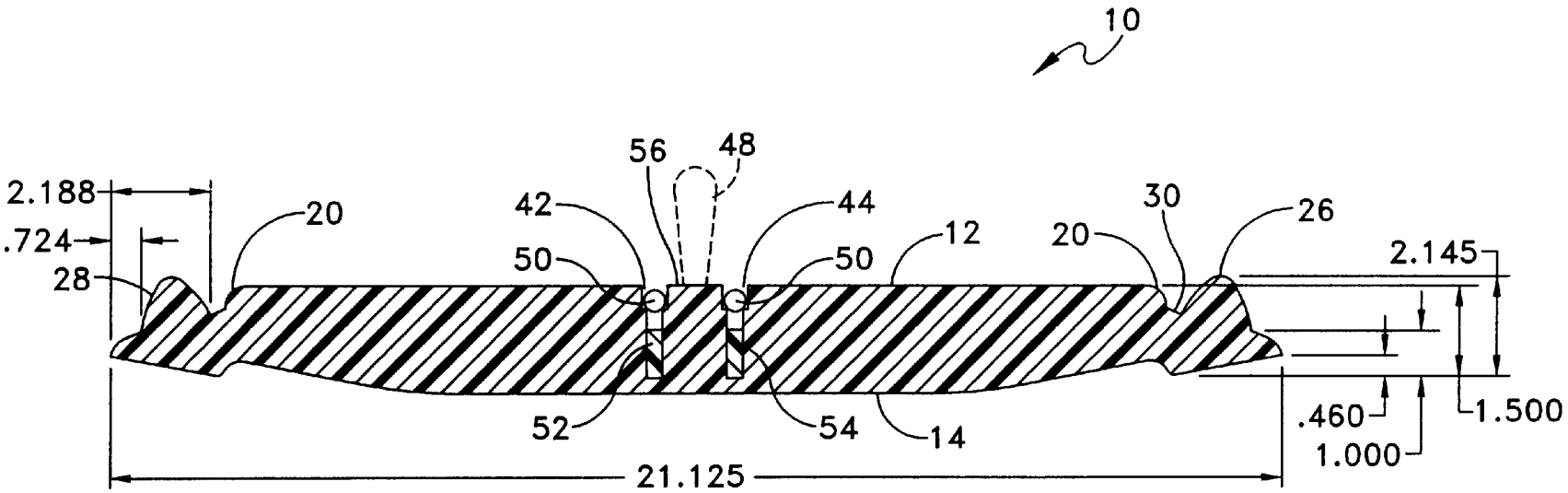
FIG. 4 is a sectional view of the kneeboard of FIG. 1 through sectional lines 4—4 of FIG. 2.

FIG. 4 is a sectional view of the kneeboard 10 of FIGS. 1–3 along sectional lines 4—4 of FIG. 2, together with representive illustrative dimensional measurements in inches to illustrate that the internal stiffeners provide a low, generally flat, planar profile of the kneeboard 10. As shown, the total thickness, including the side contour members 26 and 28 and center contour member 56, extends less than 3 inches above the top planar surface.

FIG. 5 is a perspective view to illustrate the kneeboard 10 with parallel, spaced apart dorsal fins 46 in an extended use position and the use of a lever 48 (dotted lines) in housing 40 and connected to slidable cables 50 in cable slots 42 and 44.

What is claimed is:

1. A kneeboard adapted for use behind a watercraft, which kneeboard comprises:

a) a floatation core material;

b) a polymeric shell which encapsulates the core material to form a kneeboard with a top surface, a bottom surface, opposite sides, a front end and a tail end;

c) the top surface defining a passenger area;

d) a lever housing formed in the top surface, said lever housing including a lever housing opening in the top surface;

e) a first and a second fin cable slot in the top surface of the passenger area and having a one end and another end, one end extending from the said lever housing toward the tail end, the cable slots extending downwardly and generally parallel for a selected distance and then each cable slot extending outwardly and toward opposite sides at the other end;

f) generally vertical stiffener ribs extending downwardly from the cable slots in the core material and toward the bottom surface; and g) first and second spaced apart fin slots in the bottom surface toward the tail end and in communication with the first and second fin cable slots and adapted for the installation of first and second fins.

2. The kneeboard of claim 1 which includes a pair of spaced apart, raised, rounded top surface side contour members extending substantially from the tail end to the front end of the kneeboard.

3. The kneeboard of claim 1 which includes a raised pad outer ring about the passenger area.

4. The kneeboard of claim 1 wherein the kneeboard has a total sectional thickness of less than about 3 inches.

5. The kneeboard of claim 1 wherein the core material comprises a closed-cell polymer foam material and the upper and lower shells are a molded, cross-linked polyethylene polymer.

6. The kneeboard of claim 1 which includes a flexible cushioning pad on the passenger area.

7. The kneeboard of claim 1 which includes;

a) a lever in the lever housing opening;

b) a fin cable in the fin cable slots, each having a one end and other end;

c) a fin in each fin slot; and d) the one end of the fin cables secured to the lever and the other end to each fin, whereby movement of the lever moves the fins in the fin slots between an extended use position and a restricted non-use position.

8. The kneeboard of claim 1 wherein the fin cable slots define a generally central longitudinal member with spaced apart vertical walls.

9. The kneeboard of claim 1 wherein the passenger area defines a generally planar surface with the top surface of a generally oval design.

* * * * *